US010718355B2

(12) United States Patent
Lin et al.

(10) Patent No.: US 10,718,355 B2
(45) Date of Patent: Jul. 21, 2020

(54) CENTRIFUGAL FAN

(71) Applicant: ASUSTeK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 102 days.

(21) Appl. No.: 16/112,975

(22) Filed: Aug. 27, 2018

(65) Prior Publication Data

US 2019/0072112 A1 Mar. 7, 2019

(30) Foreign Application Priority Data

Sep. 4, 2017 (CN) ..... 2017 2 1120873 U

(51) Int. Cl.
*F04D 29/66* (2006.01)
*F04D 29/28* (2006.01)
*F04D 29/30* (2006.01)

(52) U.S. Cl.
CPC ..... *F04D 29/666* (2013.01); *F04D 29/281* (2013.01); *F04D 29/30* (2013.01); (Continued)

(58) Field of Classification Search
CPC .... F04D 29/663; F04D 29/666; F04D 29/667; F04D 29/2216; F04D 29/24; F04D 29/242; F04D 29/30; F05D 2240/307
See application file for complete search history.

(56) References Cited

U.S. PATENT DOCUMENTS

2007/0134097 A1* 6/2007 Tanahashi ..... F04D 29/281 416/179
2014/0127029 A1* 5/2014 Yang ..... F04D 29/281 416/223 B (Continued)

FOREIGN PATENT DOCUMENTS

CN 102979761 A 3/2013
CN 105465043 A 4/2016

(Continued)

OTHER PUBLICATIONS

Kazuhisa, Morishita, Machine Translation of JP2008215288 (Year: 2008).*

*Primary Examiner* — Richard A Edgar
*Assistant Examiner* — Michael K. Reitz
(74) *Attorney, Agent, or Firm* — McClure, Qualey & Rodack, LLP

(57) ABSTRACT

A centrifugal fan includes a housing and an impeller. The housing includes a sidewall, and the sidewall includes a tongue portion. The impeller includes a fan hub and a plurality of blades. The fan hub is rotatably disposed in the housing, and the tongue portion has an inner contour line on a reference plane. The blades connect to the fan hub. Each one of the blades has an end surface facing the sidewall. The end surface has an outer contour line on the section of the blade. Any two adjacent blades have different outer contour lines. The outer contour line of at least one first blade of the plurality of blades is parallel to the inner contour line. The outer contour line of at least one second blade of the plurality of blades is not parallel to the inner contour line.

8 Claims, 9 Drawing Sheets

(52) U.S. Cl.
CPC ..... *F04D 29/667* (2013.01); *F05D 2240/307* (2013.01); *F05D 2250/70* (2013.01)

(56) References Cited

U.S. PATENT DOCUMENTS

| | | | | |
|---|---|---|---|---|
| 2016/0265556 | A1 | 9/2016 | Stadler et al. | |
| 2017/0002836 | A1* | 1/2017 | Herrou | F04D 29/663 |
| 2017/0184129 | A1 | 6/2017 | He | |

FOREIGN PATENT DOCUMENTS

| | | | | |
|---|---|---|---|---|
| CN | 106030119 | A | | 10/2016 |
| JP | 2008215288 | | * | 9/2008 |
| TW | I464325 | B | | 12/2014 |

* cited by examiner

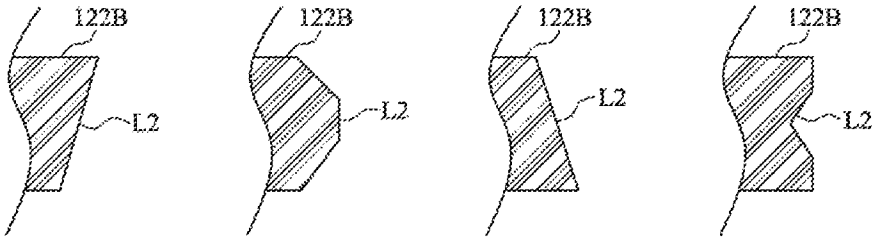
FIG. 5A
FIG. 5B
FIG. 5C
FIG. 5D
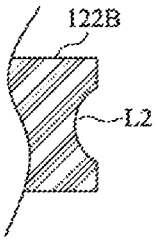
FIG. 5E
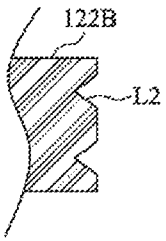
FIG. 5F
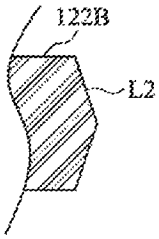
FIG. 5G
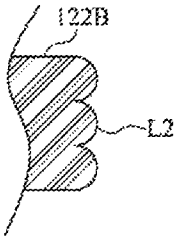
FIG. 5H
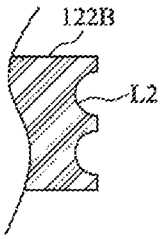
FIG. 5I

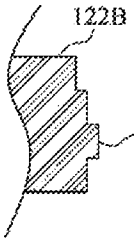
FIG. 5J
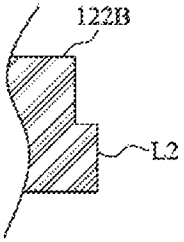
FIG. 5K
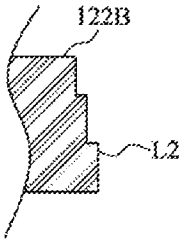
FIG. 5L
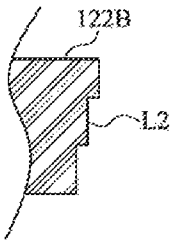
FIG. 5M
FIG. 5N
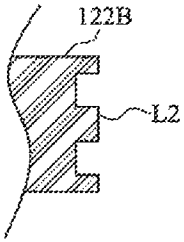
FIG. 5O
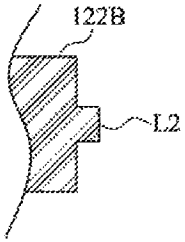
FIG. 5P
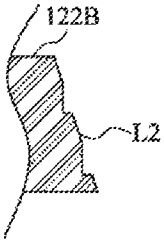
FIG. 5Q
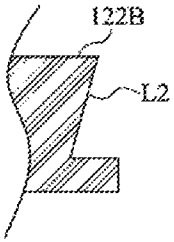
FIG. 5R

320

CENTRIFUGAL FAN

CROSS-REFERENCE TO RELATED APPLICATION

This application claims the priority benefit of Chinese application serial No. 201721120873.1, filed on Sep. 4, 2017. The entirety of the above-mentioned patent application is hereby incorporated by reference herein and made a part of the specification.

BACKGROUND OF THE INVENTION

Field of the Invention

The invention relates to a centrifugal fan.

Description of the Related Art

When a centrifugal fan is in operation, the blades pass through a tongue one by one. When passing through the tongue, the distance between the blades and the tongue becomes smaller, and the air pressure increases instantaneously. Therefore, the blades passing through the tongue periodically generates noise at a specific frequency due to the impact of air flow. Besides, when the air flow leaves the tip of the blades, the boundary layer separation of the air flow occurs, and thus the vortex flow and "air flow noise of blade tip" is generated.

BRIEF SUMMARY OF THE INVENTION

A centrifugal fan is provided, which comprising: a housing, comprising a sidewall, and the sidewall includes a tongue portion; and an impeller, comprising: a fan hub, rotatably disposed in the housing, and the tongue portion having an inner contour line on a reference plane; and a plurality of blades, connecting to the fan hub, each one of the blades having an end surface facing towards the sidewall, and the end surface having an outer contour line on the section of the blade, wherein any two adjacent blades have different outer contour lines, the outer contour line of at least one first blade of the plurality of blades is parallel to the inner contour line, and the outer contour line of at least one second blade of the plurality of blades is not parallel to the inner contour line.

A centrifugal fan is provided, which comprises: a housing; and an impeller, comprising: a fan hub, rotatably disposed in the housing along an axis, and is configured to rotate in a rotating direction; and a plurality of blades, connecting to the fan hub, the end of each one of the blades having a first extending portion and a second extending portion, the first extending portion and the second extending portion are configured along the direction of the axis, and extending directions of the first extending portion and the second extending portion are different along the rotating direction, and form an angle difference therebetween, wherein the angle differences of any two adjacent blades are different.

To sum up, in some embodiments of the centrifugal fan, the overall accumulated noise energy is reduced, thereby both the frequency noise of the blades and the phenomenon of blade tip airflow noise are decreased.

These and other features, aspects and advantages of the present invention will become better understood with regard to the following description, appended claims, and accompanying drawings.

BRIEF DESCRIPTION OF THE DRAWINGS

FIG. 5A to FIG. 5R are partial sectional views of a second blade in FIG. 2 in various embodiments respectively.

DETAILED DESCRIPTION OF THE EMBODIMENTS

Figure 1A:
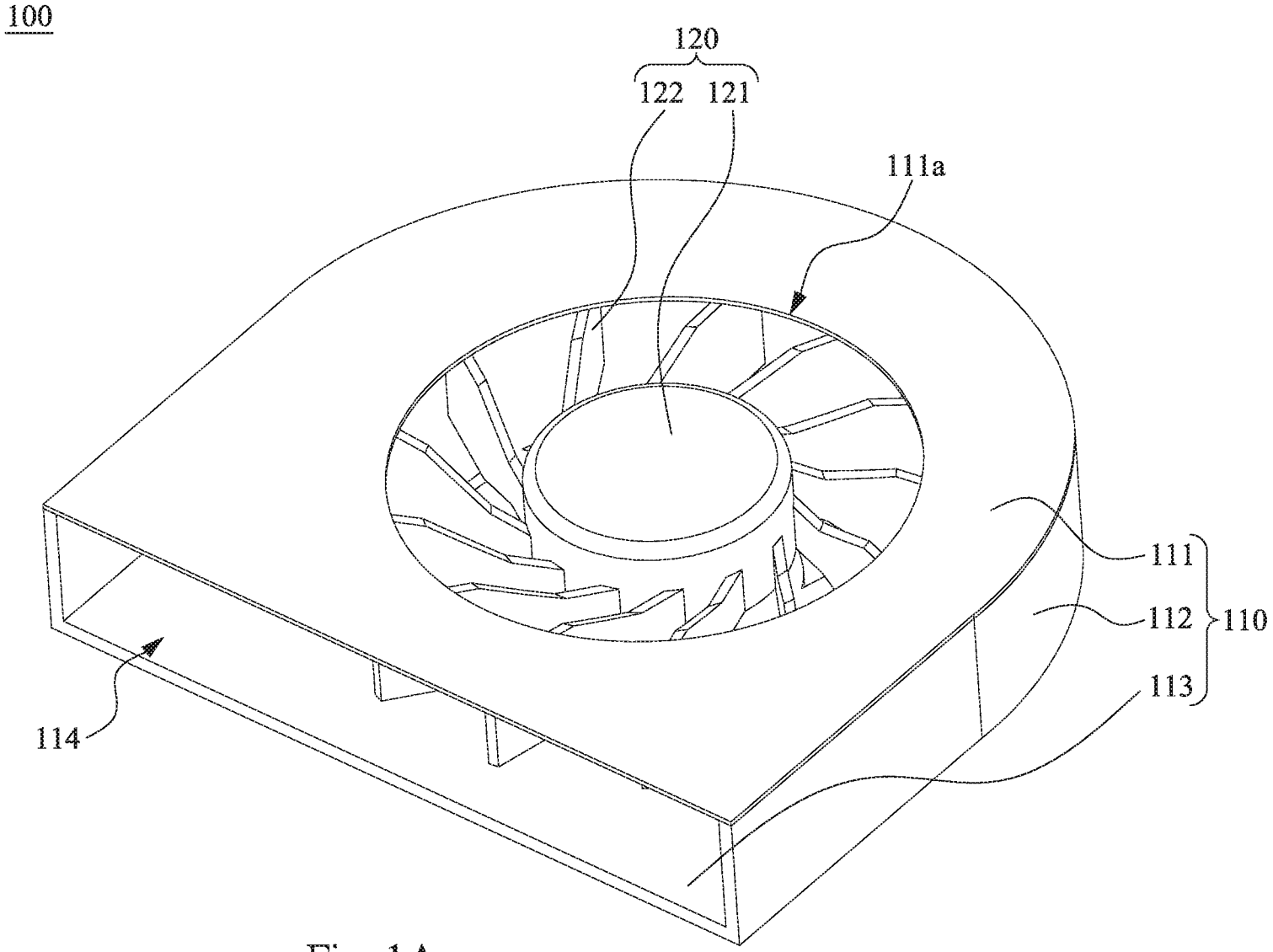
FIG. 1A is an assembling stereogram of a centrifugal fan in an embodiment.

The following discloses various embodiments with drawings. For clarity, many practical details are explained in the following description. However, it should be understood that these practical details are not applied to limit the invention. That is, in the partial implementation of this case, these practical details are not necessary. In addition, for simplifying the drawings, some known conventional structures and elements are schematically illustrated in the drawings.

Figure 1B:
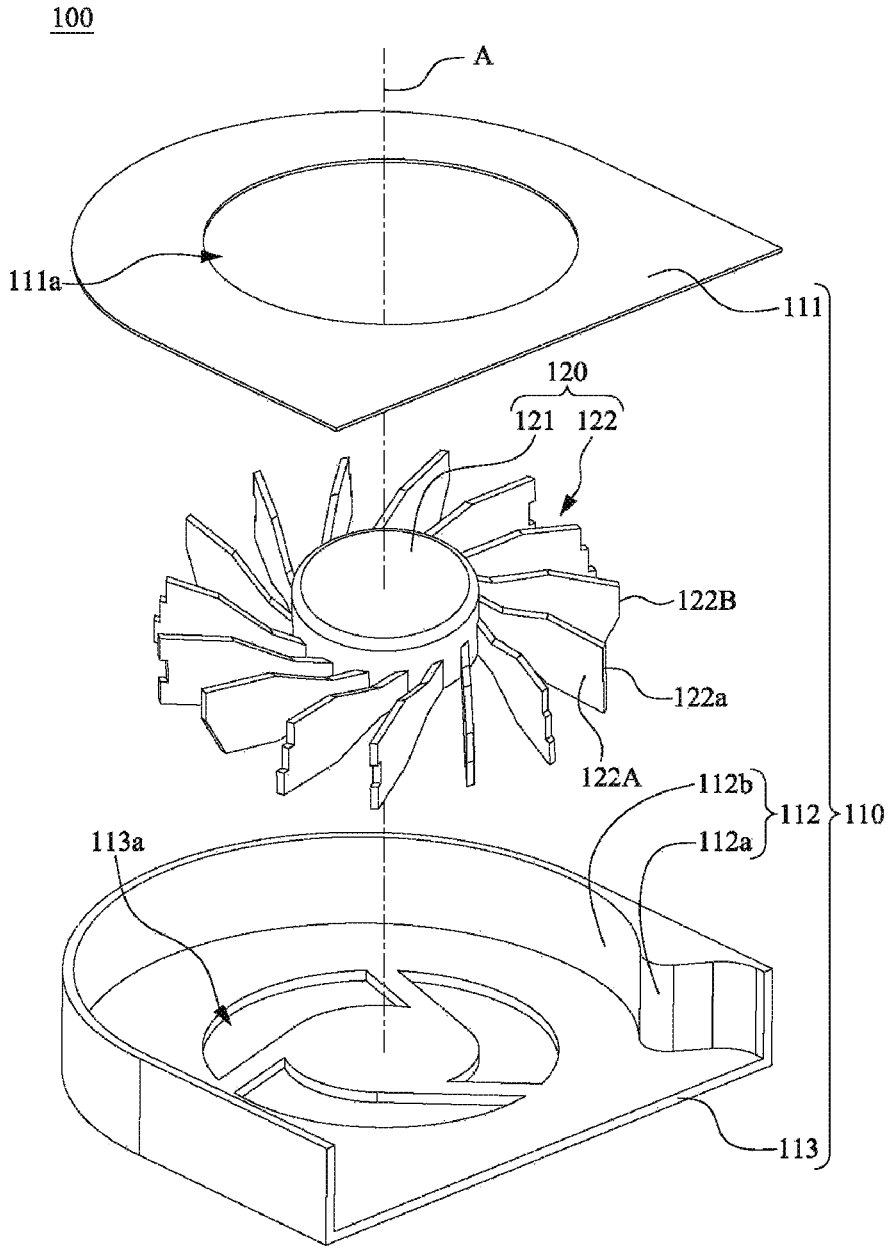
FIG. 1B is an exploded diagram of the centrifugal fan in FIG. 1A.
Figure 2:
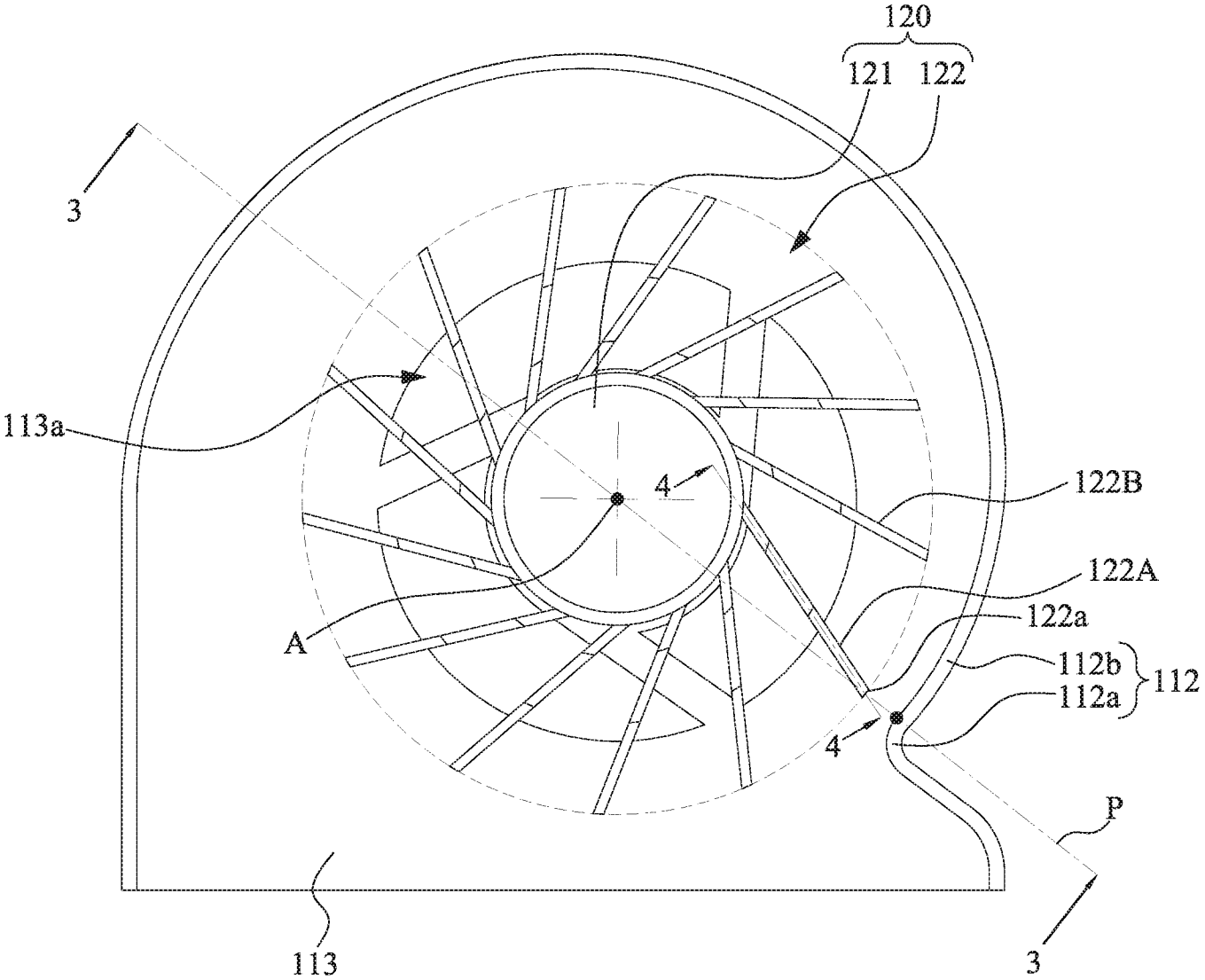
FIG. 2 is a top view of the centrifugal fan in FIG. 1A with a cover of a housing removed.

Please refer to FIG. 1A to FIG. 2. FIG. 1A is an assembling stereogram of a centrifugal fan in an embodiment. FIG. 1B is an exploded diagram of the centrifugal fan in FIG. 1A. FIG. 2 is a top view of the centrifugal fan in FIG. 1A, and a cover of a housing is removed in order to clearly show the internal structure. As shown in FIG. 1A to FIG. 2, in an embodiment, the centrifugal fan 100 includes at least a housing 110 and an impeller 120. The housing 110 includes an upper cover 111, a sidewall 112, and a lower cover 113, wherein the sidewall 112 and the lower cover 113 are integrally formed, which is not limited. The sidewall 112 has a tongue portion 112*a* and a gradually enlarged portion 112*b*. The impeller 120 includes a fan hub 121 and a plurality of blades 122. The fan hub 121 is rotatably disposed in the housing 110 along the axis A. the blades 122 are connected to an outer edge of the fan hub 121. The gradually enlarged portion 112*b* of the sidewall 112 connects the tongue portion 112*a* and surrounds the impeller 120. When the impeller 120 rotates, the air outside the housing 110 is suck by the blades 122 into the housing 110 from an upper air inlet 111*a* of the upper cover 111 and a lower air inlet 113*a* of the lower cover 113, and is gradually collected by the tongue portion 112*a* along the gradually enlarged portion 112*b*, and finally exits the housing 110 through the air outlet 114. Details of the structure and function of the above components and the connection relationship among them are explained in detail in the following.

Figure 4:
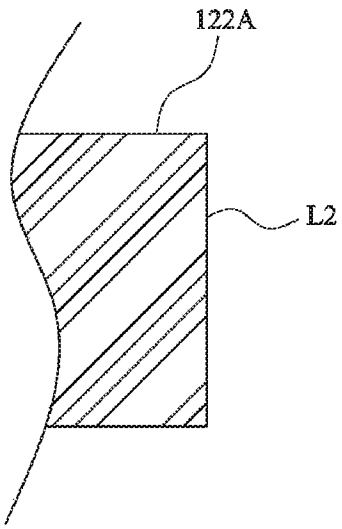
FIG. 4 is a partial sectional view of a first blade in FIG. 2 along line 4-4.
Figure 3:
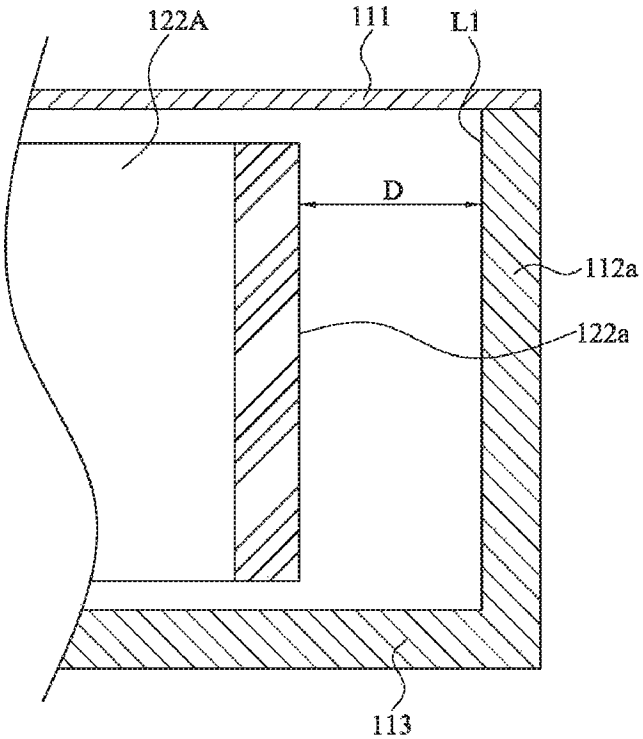
FIG. 3 is a partial sectional diagram of the structure in FIG. 2 along line 3-3.

Please refer to FIG. 3 and FIG. 4. FIG. 3 is a partial sectional diagram of the structure in FIG. 2 along line 3-3. FIG. 4 is a partial sectional view of a first blade in FIG. 2 along line 4-4. As shown in FIG. 2 to FIG. 4, in an embodiment, a reference plane P is defined through the tongue portion 112*a* and the axis A. In FIG. 2, the reference plane P is perpendicular to the plane of FIG. 2, and coincides with the line segment 3-3. The tongue portion 112*a* has an inner contour line L1 on the reference plane P (see FIG. 3). In some embodiments, the reference plane P is further defined through the junction of the tongue portion 112*a* and the gradually enlarged portion 112*b*, which is not limited.

Each blade 122 has an end surface 122*a* facing the sidewall 112. A section (shown as the line segment 4-4 in FIG. 2) is defined to be parallel to the axis A and through the end surface 122*a*. The end surface 122*a* has an outer contour line L2 on the section (see FIG. 4). In fact, a longitudinal section is defined on each blade 122 passing through the entire blade 122 (including the end surface 122*a*), and is parallel to the axis A.

In an embodiment, the outer contour line L2 (see FIG. 4) of at least one first blade 122A in the blades 122 and the inner contour line L1 (see FIG. 3) of the tongue portion 112*a* are parallel to each other. In the embodiment, the outer contour line L2 of the first blade 122A and the inner contour line L1 of the tongue portion 112*a* are both perpendicular to the lower cover 113, which is not limited herein and is adjusted according to requirements. In addition, when the first blade 122A moves to lead the end surface 122*a* to intersect with the reference plane P (as shown in FIG. 2), the end surface 122*a* and the inner contour line L1 have a minimum distance D (as shown in FIG. 3).

Please refer to FIGS. 5A-5R. FIG. 5A to FIG. 5R are partial sectional views of second blades in FIG. 2 in various embodiments respectively. As shown in FIG. 2 and FIG. 5A to FIG. 5R, in the embodiment, an outer contour line L2 of at least one second blade 122B (please refer to any one of FIGS. 5A to 5R) in the blades 122 are not parallel to the inner contour line L1 of the tongue portion 112*a* (please refer to FIG. 3).

In the present embodiment, the outer contour lines L2 of any two adjacent blades 102 is different. By the abovementioned structural arrangement, the pressure acting on each of the blades 122 and the tongue portion 112*a* is different and forms the different pressure impact strengths, so accumulation of the overall noise energy is decreased to reduce the frequency noise of the blades. Since at least one outer contour line L2 of the first blade 122A is parallel to the inner contour line L1 of the tongue portion 112*a* and has the minimum distance D therebetween, and at least one outer contour line L2 of the second blade 122B is not parallel to the inner contour line L1 of the tongue, which reduces the performance loss caused by the general design type. Since the outer contour line L2 of the second blade 122B has a plurality of external diameters with respect to the axis A, both velocity of the airflow at each height position of the second blade 122B in the direction of the axis A and the positions of the air flow leaving from the tip of the blade 122 are different. Therefore, the vortex flow is not synchronized formed, which effectively reduces the phenomenon and intensity of the vortex flow, and decreases the airflow noise of blade tip.

As shown in FIG. 5A to FIG. 5R, the outer contour line L2 of the second blade 122B of any shape has multiple outer diameters with respect to the axis A (please refer to FIG. 2). The external diameter of the outer contour line L2 of the second blades 122B shown in FIG. 5A to FIG. 5I is gradually changed in the direction of the axis A. In some embodiments, the outer diameters of the outer contour line L2 are gradually increased from the upper edge of the outer contour line L2 to the lower edge of the outer contour line L2. In other embodiments, the outer diameters of the outer contour line L2 gradually decrease from the upper edge of the outer contour line L2 to the lower edge of the outer contour line L2. The outer diameters of the outer contour line L2 of the second blades 122B shown in FIG. 5J to FIG. 5P are stepwise changed in the direction of the axis A. The outer diameters of the outer contour line L2 of the second blades 122B shown in FIG. 5Q and FIG. 5R are partially gradually and partially stepwise changed in the direction of the axis A.

In some embodiments, the impeller 120 includes a plurality of the aforementioned first blades 122A, and the first blades 122A are periodically annularly configured in the blades 122. In some embodiments, the impeller 120 includes a plurality of the same type of the second blade 122B (please refer to any one of FIGS. 5A to 5R), and the second blade 122B is cyclically configured in all the blades 122.

In some embodiments, the outer contour lines L2 of any three blades 122 which are configured in sequence in the blades are different. In an embodiment, the blades 122 included in the impeller 120 are formed by periodically annularly arranging the first blade 122A shown in FIG. 4, the second blade 122B shown in FIG. 5A, and the second blade 122B shown in FIG. 5B sequentially, which is not limited thereto. In actual applications, the blades 122 included in the impeller 120 are formed by periodically annularly arranging a plurality of the first blades 122A among the second blades 122B with different shapes.

Figure 6:
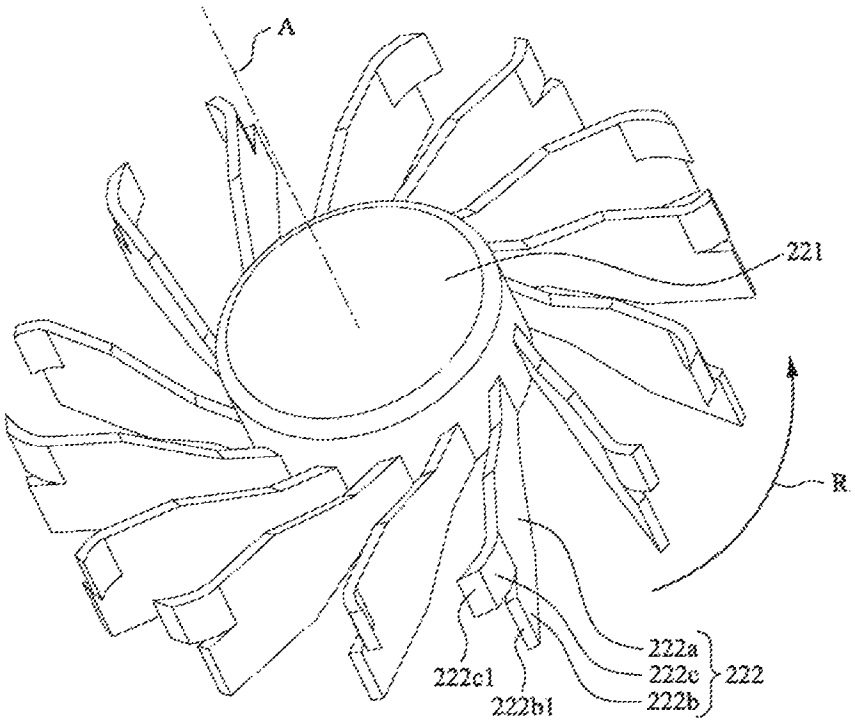
FIG. 6 is a stereogram of an impeller in an embodiment.
Figure 7:
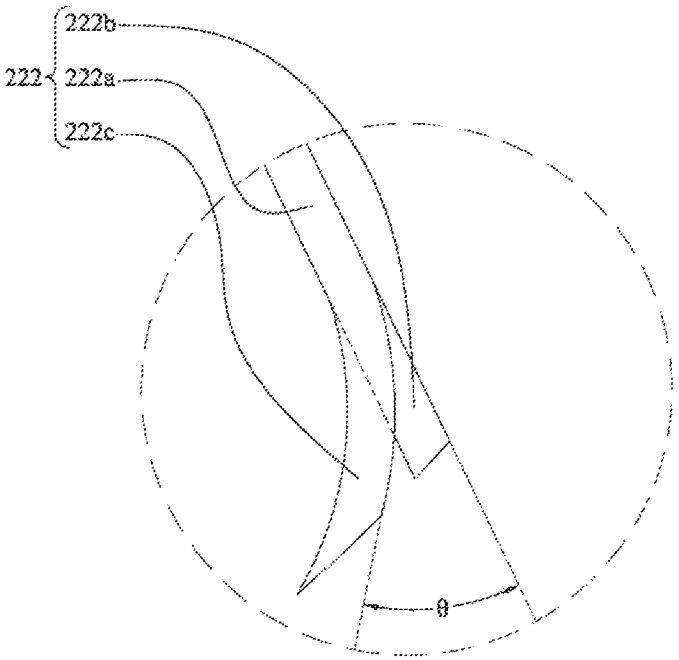
FIG. 7 is a partial top view of the impeller in FIG. 6.

Please refer to FIG. 6 and FIG. 7. FIG. 6 is a stereogram of an impeller in an embodiment. FIG. 7 is a partial top view of the impeller in FIG. 6. As shown in FIG. 6 and FIG. 7, an impeller 220 replaces the impeller 120 shown in FIG. 1B, and the impeller 220 includes a fan hub 221 and a plurality of blades 222. The fan hub 221 is rotatably disposed in the housing 110 along the axis A, and is configured to rotate in a rotating direction R. The blades 222 are connected to the outer edge of the fan hub 221.

Each of the blades 222 includes a body portion 222*a*, a first extending portion 222*b*, and a second extending portion 222*c*. In the radial direction perpendicular to the axis A, one end of the body portion 222*a* is connected to the fan hub 221, and the other end of the body portion 222*a* is connected to the corresponding first extending portion 222*b* and the second extending portion 222*c*. The first extending portion 222*b* and the second extending portion 222*c* are configured in the direction of the axis A. Also, the extending directions of the first extending portion 222*b* and the second extending portion 222*c* are different along the rotating direction R, and form an angle difference θ therebetween.

In the present embodiment, angle differences θ of any two adjacent blades 222 are different. By the foregoing structural configuration (that is, by misaligning the distribution of airflow at the tip of the blades 222 at different heights), the phenomenon that the different vortex flow formed by the different blades 222 in the same radial position is out of sync, which effectively reduce the phenomenon and intensity of the vortex flow, and decrease the airflow noise of blade tip.

In some embodiments, the body portion 222*a* and the first extending portion 222*b* on the same blade 222 are parallel to each other. In some embodiments, the second extending portion 222*c* is biased toward the rotating direction R with respect to the first extending portion 222*b*. In some other embodiments, the second extending portion 222*c* is biased opposite to the direction of rotating direction R relative to the first extending portion 222*b*.

In some embodiments, the first extending portion 222*b* and the second extending portion 222*c* respectively have end surfaces 222*b*1, 222*c*1 away from the fan hub 221, and the end surfaces 222*b*1, 222*c*1 have the same external diameter with respect to the axis A.

In some embodiments, a angle difference θ is the same between the first extending portion 222*b* and the second extending portion 222*c* in the extending direction of each blade of a group of the blades 322, and the group is periodically annually configured in the blades 322.

Figure 8:
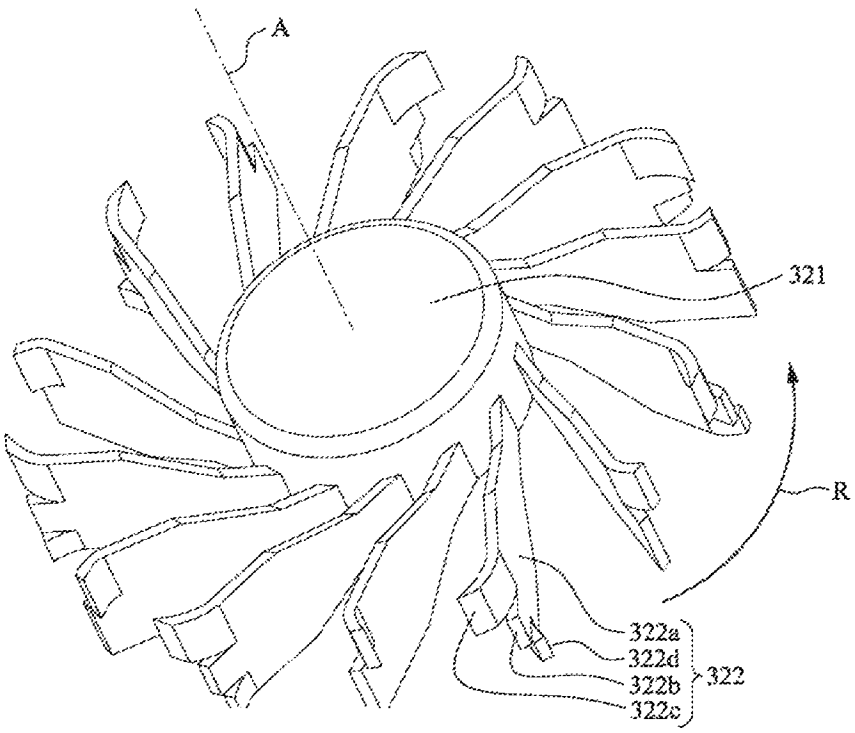
FIG. 8 is a stereogram of an impeller in another embodiment.

Please refer to FIG. 8, which is a stereogram of an impeller in another embodiment. As shown in FIG. 8, the impeller 320 replaces the impeller 120 shown in FIG. 1B, and the impeller 320 includes a fan hub 321 and a plurality of blades 322. The fan hub 321 rotatably disposed in the housing 110 along the axis A and is configured to rotate in a rotating direction R. The blades 322 are connected to the outer edge of the fan hub 321.

Some of the blades 322 of the impeller 320 each include a body portion 322*a*, a first extending portion 322*b*, a second extending portion 322*c*, and a third extending portion 322*d*. In a radial direction perpendicular to the axis A, one end of the body portion 322*a* is connected to the fan hub 321, and the other end of the body portion 322*a* is connected to the corresponding first extending portion 322*b*, the second extending portion 322*c*, and third extending portion 322*d*. The first extending portion 322*b*, the second extending portion 322*c*, and the third extending portion 322*d* are configured in the direction of the axis A. The extending directions of any two of the first extending portion 322*b*, the second extending portion 322*c*, and the third extending portion 322*d* are different in the rotating direction R, and an angle difference θ is formed therebetween.

In one embodiment, the body portion 322*a* is parallel to the first extending portion 322*b* of the same blade 322, the second extending portion 322*c* is biased along the rotating direction R relative to the first extending portion 322*b*, and the third extending portion is biased opposite to the rotating direction R relative to the first extending portion 322*b*, which is not limited.

In some embodiments, Each of the first extending portions 322*b*, the second extending portions 322*c*, and the third extending portion 322*d* has an end surface away from the fan hub 321, and these end surfaces have the same external diameter with respect to the axis A.

In some embodiments, in the direction of the axis A, the first extending portion 322*b* is configured between the second extending portion 322*c* and the third extending portion 322*d*, which is not limited. In one embodiment, any two phases are used. The orders of the first extending portion 322*b*, the second extending portion 322*c*, and the third extending portion 322*d* of any two adjacent blades 322 in the direction of the axis A are different.

In some embodiments, the impeller 320 also includes at least one of the blades 222 shown in FIG. 6. That is, the impeller 320 includes both the blades 222 having two extending portions and the blades 322 having three extending portions. In one embodiment, the number of extending sections included in the blades 322 is increased or decreased as required.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

What is claimed is:

1. A centrifugal fan, comprising:

a housing, comprising a sidewall, and the sidewall includes a tongue portion; and an impeller, comprising:

a fan hub, rotatably disposed in the housing, and the tongue portion having an inner contour line on a reference plane; and a plurality of blades, connecting to the fan hub, each one of the blades having an end surface facing towards the sidewall, and the end surface having an outer contour line on the section of the blade, wherein any two adjacent blades have different outer contour lines, the outer contour line of at least one first blade of the plurality of blades is parallel to the inner contour line, and the outer contour line of at least one second blade of the plurality of blades is not parallel to the inner contour line, wherein the outer contour lines of any three blades which are configured in sequence in the blades are different.

2. The centrifugal fan according to claim 1, wherein, when at least one of the first blades moves to lead the end surface and the reference plane to intersect, a minimum distance exists between the end surface of the at least one blade and the inner contour line.

3. The centrifugal fan according to claim 1, wherein the fan hub is rotatably disposed in the housing along an axis, and the outer contour line of the at least one second blade has multiple outer diameters with respect to the axis.

4. The centrifugal fan according to claim 3, wherein the outer diameters of the outer contour line of the at least one second blade is gradually increased from an upper edge of the outer contour line to a lower edge of the outer contour line.

5. The centrifugal fan according to claim 3, wherein the outer diameters of the outer contour line of the at least one second blade is gradually decreased from an upper edge of the outer contour line to a lower edge of the outer contour line.

6. The centrifugal fan according to claim 3, wherein the outer diameters of the outer contour line of the at least one second blade is stepwise changed in the direction of the axis.

7. The centrifugal fan according to claim 1, wherein the number of the at least one first blade is plural, and the first blades are periodically annularly configured in the blades.

8. The centrifugal fan according to claim 1, wherein the number of the at least one second blade is plural, and the second blades are periodically annularly configured in the blades.

* * * * *